US009311845B2

(12) United States Patent
Cheng

(10) Patent No.: US 9,311,845 B2
(45) Date of Patent: Apr. 12, 2016

(54) METHOD AND APPARATUS FOR GRAY-SCALE GAMMA CORRECTION FOR ELECTROLUMINESCENT DISPLAYS

(71) Applicant: Chun-Fai Cheng, Newmarket (CA)

(72) Inventor: Chun-Fai Cheng, Newmarket (CA)

(73) Assignee: IFIRE IP CORPORATION, Fort Saskatchewan (CA)

( * ) Notice: Subject to any disclaimer, the term of this patent is extended or adjusted under 35 U.S.C. 154(b) by 0 days.

(21) Appl. No.: 14/071,169

(22) Filed: Nov. 4, 2013

(65) Prior Publication Data

US 2014/0210874 A1 Jul. 31, 2014

Related U.S. Application Data

(63) Continuation of application No. 10/701,051, filed on Nov. 4, 2003, now abandoned.

(60) Provisional application No. 60/423,569, filed on Nov. 4, 2002.

(51) Int. Cl.

| | |
|---|---|
| ***G09G 3/32*** | (2006.01) |
| ***G09G 3/30*** | (2006.01) |
| *G09G 3/36* | (2006.01) |

(52) U.S. Cl.

CPC .. *G09G 3/32* (2013.01); *G09G 3/30* (2013.01); *G09G 3/3614* (2013.01); *G09G 2310/027* (2013.01); *G09G 2310/0259* (2013.01); *G09G 2320/0276* (2013.01)

(58) Field of Classification Search

CPC ..... G09G 3/30; G09G 2310/0259; G09G 3/2011; G09G 2310/027; G09G 3/3688; G09G 3/3614; G09G 2330/023

USPC ..... 345/55, 76, 77, 78, 79, 80, 82, 83, 204, 345/205, 206, 208, 209, 210, 690, 691, 692, 345/693, 694; 315/169.3

See application file for complete search history.

(56) References Cited

U.S. PATENT DOCUMENTS

| | | | |
|---|---|---|---|
| 5,227,863 | A | 7/1993 | Bilbrey et al. |
| 5,311,169 | A | 5/1994 | Inada et al. |

(Continued)

FOREIGN PATENT DOCUMENTS

| | | |
|---|---|---|
| WO | WO 01/61677 | 8/2001 |

OTHER PUBLICATIONS

Steiner S.A., et al., "High-Performance Column Driver for Gray-Scale TFEL Displays", International Symposim of the SID, Anaheim, California, May 24-26, 1988; Playa Del Rey, SID, US, vol. Symp 29, May 24, 1988, pp. 31-34.

*Primary Examiner* — Koosha Sharifi-Tafreshi
(74) *Attorney, Agent, or Firm* — Fay Sharpe LLP

(57) ABSTRACT

A circuit and method of driving a display panel requiring gray scale control wherein the voltage applied to a row of pixels is equal to the sum of voltages of opposite sign with respect to ground applied respectively to the row electrode and column electrodes whose intersection with the row defines the pixels. Gray scale is realized through modulation of the voltage applied to the column electrodes. Typically for video application, 256 individual gray levels are required corresponding to luminance levels ranging from zero (no emissive luminance) to full luminance. The required luminance for each gray level is not a linear function of the gray level number but rather corresponds to an approximate quadratic function of this number. The present invention facilitates generation of luminance values for each gray level that approximates this functional dependence (i.e. Gamma corrected) with a non-linear voltage ramp terminated by a digital clock having 256 (8 bit) resolution. The voltage at the ramp termination is held at a constant value and fed to the output buffer of the gray scale drivers for the display columns.

11 Claims, 6 Drawing Sheets

(56) References Cited

U.S. PATENT DOCUMENTS

| | | | | | |
|---|---|---|---|---|---|
| 5,440,208 | A | | 8/1995 | Uskali et al. | |
| 5,510,851 | A | | 4/1996 | Foley et al. | |
| 5,550,557 | A | | 8/1996 | Kapoor et al. | |
| 5,587,676 | A | | 12/1996 | Chowdhury | |
| 5,652,600 | A | | 7/1997 | Khormaei et al. | |
| 5,786,797 | A | * | 7/1998 | Kapoor et al. | 345/79 |
| 5,812,104 | A | * | 9/1998 | Kapoor et al. | 345/76 |
| 5,956,015 | A | | 9/1999 | Hino | |
| 5,990,629 | A | | 11/1999 | Yamada et al. | |
| 6,049,320 | A | | 4/2000 | Yeo | |
| 6,111,555 | A | | 8/2000 | Haas | |
| 6,137,462 | A | * | 10/2000 | Kim | 345/94 |
| 6,297,791 | B1 | | 10/2001 | Naito et al. | |
| 6,380,919 | B1 | | 4/2002 | Koyama et al. | |
| 6,417,825 | B1 | | 7/2002 | Stewart et al. | |
| 6,448,950 | B1 | | 9/2002 | Cheng | |
| 6,518,962 | B2 | | 2/2003 | Kimura et al. | |
| 6,535,207 | B1 | | 3/2003 | Hiroki | |
| 6,819,308 | B2 | | 11/2004 | Cheng | |
| 6,844,874 | B2 | | 1/2005 | Maurice | |
| 6,987,509 | B1 | | 1/2006 | Haas | |
| 6,995,753 | B2 | | 2/2006 | Yamazaki et al. | |
| 7,187,355 | B2 | | 3/2007 | Tam et al. | |
| 2002/0130827 | A1 | | 9/2002 | Maurice | |
| 2003/0011554 | A1 | * | 1/2003 | Albu et al. | 345/89 |

* cited by examiner

STEPWISE LINEAR APPROXIMATION OF GAMMA CORRECTION CURVE

Block Diagram of Non-linear Ramp Generator for Gamma Correction of EL Panels

METHOD AND APPARATUS FOR GRAY-SCALE GAMMA CORRECTION FOR ELECTROLUMINESCENT DISPLAYS

This application is a continuation of U.S. patent application Ser. No. 10/701,051, filed Nov. 4, 2003, which claims the benefit of U.S. Provisional Application No. 60/423,569, filed Nov. 4, 2002, both of which are incorporated herein by reference in their entirety.

FIELD OF THE INVENTION

The present invention relates generally to flat panel displays, and more particularly to a method and apparatus for driving a display panel requiring gray scale control by modulation of the voltage applied to the column electrodes with a non-linear voltage ramp.

BRIEF DESCRIPTION OF THE DRAWINGS

The Background of the Invention and Detailed Description of the Preferred Embodiment are set forth herein below with reference to the following drawings, in which.

BACKGROUND OF THE INVENTION

Electroluminescent displays are advantageous by virtue of their low operating voltage with respect to cathode ray tubes, their superior image quality, wide viewing angle and fast response time over liquid crystal displays, and their superior gray scale capability and thinner profile than plasma display panels.

Figure 1:
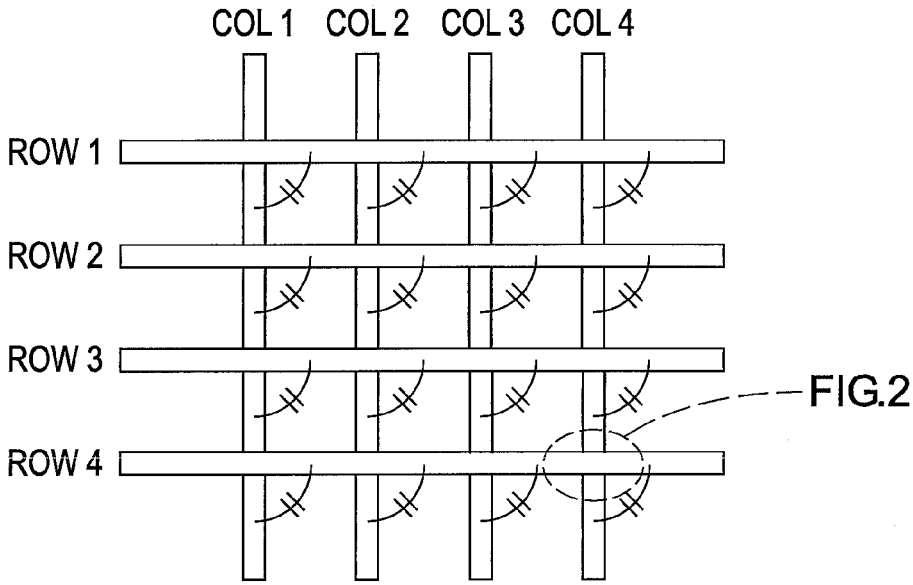
FIG. 1 (PRIOR ART)
FIG. 1 is a plan view of an arrangement of rows and columns of pixels of an electroluminescent display, in accordance with the Prior Art.
Figure 2:
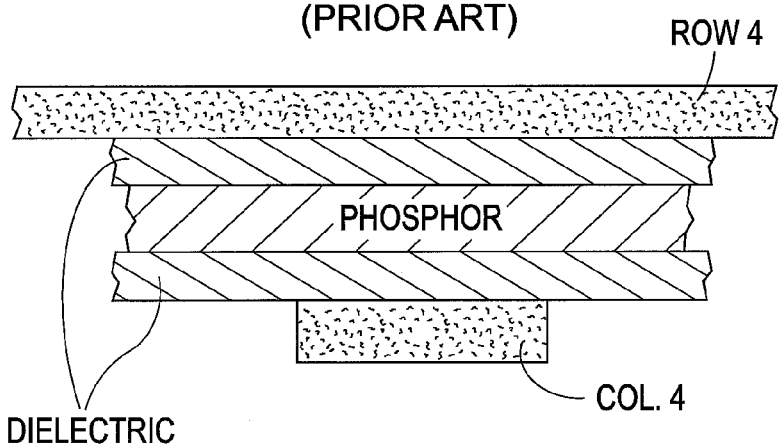
FIG. 2 (PRIOR ART)
FIG. 2 is a cross section through a single pixel of the electroluminescent display of FIG. 1.

As shown in FIGS. 1 and 2, an electroluminescent display has two intersecting sets of parallel electrically conductive address lines called rows (ROW 1, ROW 2, etc.) and columns (COL 1, COL 2, etc.) that are disposed on either side of a phosphor film encapsulated between two dielectric films. A pixel is defined as the intersection point between a row and a column. Thus, FIG. 2 is a cross-sectional view through the pixel at the intersection of ROW 4 and COL 4, in FIG. 1. Each pixel is illuminated by the application of a voltage across the intersection of row and column defining the pixel.

Matrix addressing entails applying a voltage below the threshold voltage to a row while simultaneously applying a modulation voltage of the opposite polarity to each column that bisects that row. The voltages on the row and the column are summed to give a total voltage in accordance with the illumination desired on the respective sub-pixels, thereby generating one line of the image. An alternate scheme is to apply the maximum sub-pixel voltage to the row and apply a modulation voltage of the same polarity to the columns. The magnitude of the modulation voltage is up to the difference between the maximum voltage and the threshold voltage to set the pixel voltages in accordance with the desired image. In either case, once each row is addressed, another row is addressed in a similar manner until all of the rows have been addressed. Rows that are not addressed are left at open circuit.

The sequential addressing of all rows constitutes a complete frame. Typically, a new frame is addressed at least about 50 times per second to generate what appears to the human eye as a flicker-free video image.

In order to generate realistic video images with flat panel displays, it is important to provide the required luminosity ratios between gray levels where the driving voltage is regulated to facilitate gray scale control. This is particularly true for electroluminescent displays where gray scale control is exercised through control of the output voltage on the column drivers for the display.

Traditional thin film electroluminescent displays employing thin dielectric layers that sandwich a phosphor film interposed between driving electrodes are not amenable to gray scale control through modulation of the column voltage, due to the very abrupt and non-linear nature of the luminance turn-on as the driving voltage is increased. By way of contrast, electroluminescent displays employing thick, high dielectric constant dielectric layered pixels have a nearly linear dependence on the luminance above the threshold voltage, and are thus more amenable to gray scale control by voltage modulation. However, even in this case if the gray scale voltage levels are generated by equally spaced voltage levels then the luminance values of the gray levels are not in the correct ratios for video applications.

The gray level information in a video signal is digitally encoded as an 8 bit number. These digitally coded gray levels are used to generate reference voltage levels $V_g$ that facilitate the generation of luminance levels (Lg) for each gray level in accordance with an empirical relationship of the form:

$$Lg=f(V_g)=An^{\gamma} \quad \text{(Equation 1)}$$

where $f(V_g)$ represents that the luminance is a function of the voltage applied to a pixel and A is a constant, n is the gray level number and $\gamma$ is typically between 2 and 0.2.5.

An electroluminescent (EL) display driver with gray scale capability resembles a digital-to analog (D/A) device with an output buffer. The purpose is to convert incoming gray scale 8-bit digital data from the video source to an analog output voltage for panel driving. There are various types of gray scale drivers, each employing a different method of performing the necessary digital-to-analog conversion. The present invention is related to the type of gray scale drivers that use a linear ramping voltage as a means of performing the D/A conversion. For this type of driver, the digital gray level code is first converted to a pulse-width through a counter operated by a fixed frequency clock. The time duration of this pulse-width is a representation of, and corresponds to, the gray level digital code. The pulse-width output of the counter controls a capacitor sample-and-hold circuit which operates in conjunction with an externally generated linear voltage ramp to achieve the pulse-width to voltage conversion. Since the linear ramp has a linear relationship between the output voltage and time, the pulse-width representation of the digital code therefore generates a linear gray level voltage at the driver output. The luminance created for each level is then dependent on the relationship between the voltage applied to a pixel and the pixel luminance, which is the basic electro-optical characteristic of the particular panel. This luminance-voltage characteristic is normally different from the ideal characteristic, and therefore Gamma correction is necessary.

Figure 3:
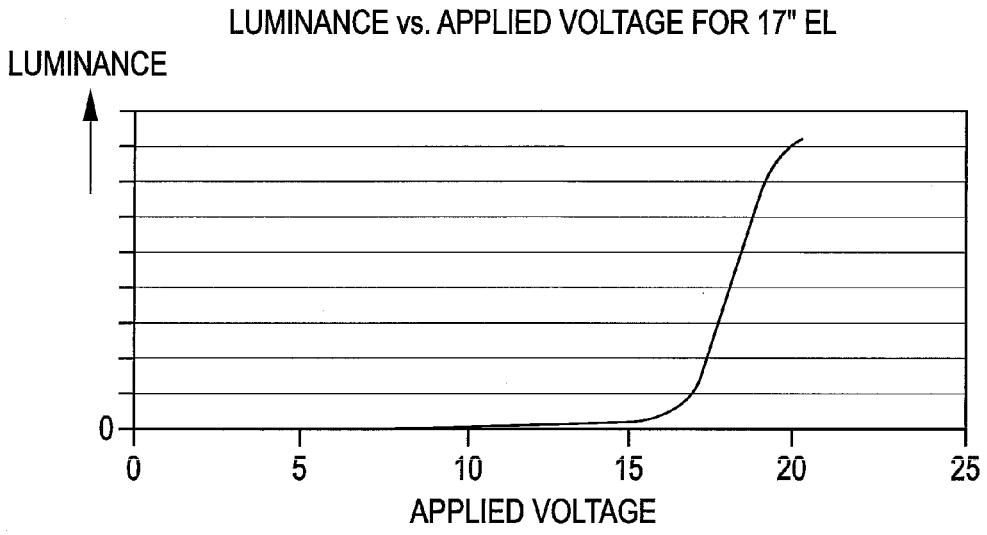
FIG. 3 (PRIOR ART)
FIG. 3 is a luminance versus applied voltage curve for the electroluminescent pixel of FIG. 1.

The relationship between the voltage applied to a pixel and its luminance is typified by the curve in FIG. 3. The luminance begins to rise above the threshold voltage in a nonlinear fashion for the first few volts above the threshold, and then rises in an approximate linear fashion before saturating at a fixed luminance. The portion of the curve used for display operation is the initially rising portion and the linear portion. The effects of differential loading of the driver outputs complicate the relationship. To negate the effect of variable loading and to improve the energy efficiency of the display, a driver employing a sinusoidal drive voltage with a resonant energy recovery feature is typically employed. Such a driver is disclosed in U.S. patent application Ser. No. 09/504,472 (now U.S. Pat. No. 6,448,950) and U.S. patent application Ser. No. 10/036,002 (now U.S. Pat. No. 6,819,308), the contents of which are incorporated herein by reference. However, it is nonetheless desirable to tailor the output voltage for the gray levels to generate a gray scale response similar to that described by the empirical relationship given by Equation 1.

According to the prior art, circuits are known for gray scale compensation in flat panel displays.

For example, U.S. Pat. No. 5,652,600 (Khormaei et al) discloses a gray-scale correction system for EL displays which involves illuminating first selected pixel electrodes with data signals during a first subframe time period of the received image and thereafter energizing a second set of selected pixel electrodes with data signals during the next subframe time period where the first and second illumination signals have predetermined characteristics that differ from each other. The structure of the EL display is complex, and does not suggest the use of a reference voltage generator that employs a non-linear voltage ramp to generate gray-scale levels having correct luminance levels in an EL display.

U.S. Pat. No. 5,812,104 (Kapoor et al) discloses the use of different levels of pixel luminance to achieve correct gray-scaling in an EL display. The '104 patent acknowledges the problem of prior art ramp generators to adequately vary the rate of the ramped voltage signal from a constant value throughout the ramp. In response to that, the '104 patent sets forth a gray-scale stepped ramp voltage generator constructed so that various step sizes may be obtained during each of the voltage steps. The disclosed circuit is very complex and is not capable of generating an intensity dynamic range of 256×256 (gamma=2.0 per equation 1) between lowest and highest gray levels. Further, the use of TFEL devices is not amenable to achieving the gray levels to meet television standards, as set forth above.

U.S. Pat. No. 6,417,825 (Stewart et al) discloses an EL display with gray-scale and a ramp voltage that may be made non-linear. However, the '825 patent is applicable only to active matrix EL and to frame rate modulation, not passive matrix EL and voltage modulation.

The following prior art is of background interest to the present invention:

U.S. Pat. No. 5,227,863 (Bilbrey et al) U.S. Pat. No. 5,550,557 (Kapoor et al)

SUMMARY OF THE INVENTION

According to the present invention, Gamma correction of an EL panel is conveniently effected at the D/A conversion stage of a gray scale driver by replacing the conventional linear voltage ramp with a non-linear voltage ramp.

Thus, a gray scale reference voltage generator is set forth herein that employs a non-linear voltage ramp in combination with a counter and a sample-and-hold circuit to achieve digital data to gray level conversion with proper Gamma correction. The shape of the voltage ramp is defined to generate gray scale levels according to Equation 1 taking into account the shape of the luminance versus voltage curve for a pixel, as shown in FIG. 3 for a thick dielectric electroluminescent display. The optimum curve of the voltage ramp therefore a convex shape (negative second derivative with respect to time) for an initial portion of the voltage range and a concave shape (positive second derivative with respect to time) for the remaining portion of the ramp to maximum luminance. The non-linear voltage ramp of the present invention permits the use of a clock that is required to delineate only 256 time intervals for fully defining 256 gray levels. The voltage ramp also simplifies the process of generating a Gamma corrected gray level voltage at the driver output in accordance with gray level data from the incoming video signal.

Other and further advantages and features of the invention will be apparent to those skilled in the art from the following detailed description thereof, taken in conjunction with the accompanying drawings introduced herein above.

DESCRIPTION OF THE PREFERRED EMBODIMENTS

Figure 4:
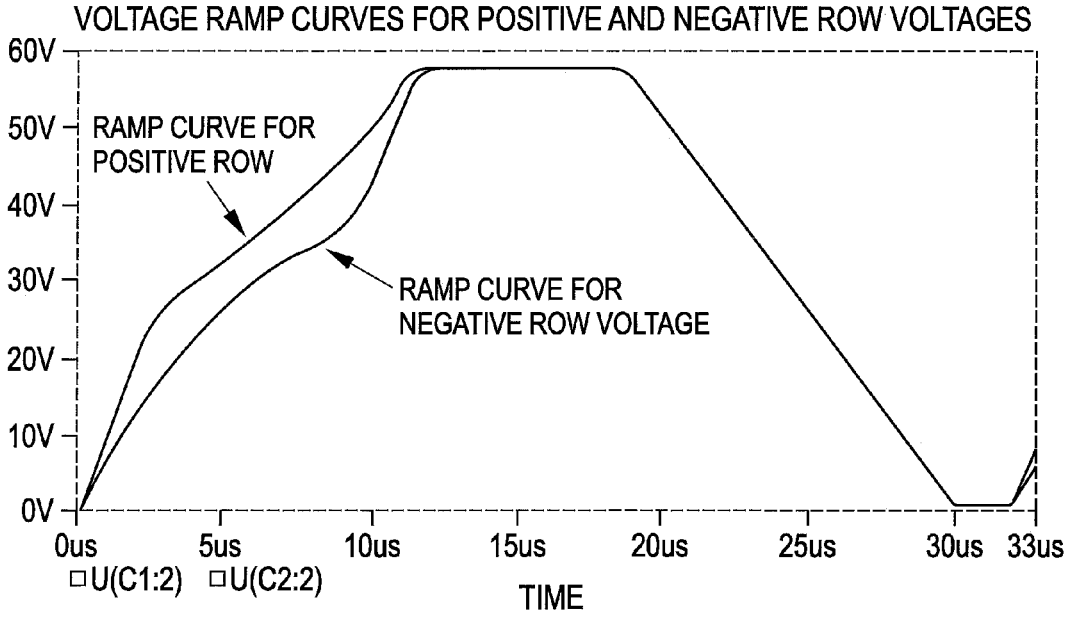
FIG. 4 shows voltage ramp curves for negative row voltage and for positive row voltage to generate gray scale luminance from the luminance versus voltage curve of FIG. 3.

With reference to FIGS. 1, 2 and 3, and in contrast with the prior art, the present invention is optimized for use with an electroluminescent display having a thick film dielectric layer. A typical curve showing luminance versus driving voltage pulse amplitude for such a display is shown in FIG. 3. Ideal gray level generating voltage ramp functions for positive and for negative row voltages generated for the luminance curve of FIG. 3 are shown in FIG. 4, as discussed in greater detail below.

As shown in the block diagram of FIG. 6, the gray-scale circuit according to the present invention uses a non-linear voltage ramp to generate reference voltages to define specified gray levels on the columns, as discussed in greater detail below.

In operation, row electrodes are sequentially addressed to generate the complete frame image. As discussed above, voltages are applied essentially simultaneously to the columns of each addressed row to create the pixel luminosities required to generate the image for each frame. In order to eliminate time-averaged electric potential across any one pixel (a condition that shortens the life of a display due to degradation mechanisms associated with electric field assisted diffusion of chemical species in the pixel), the rows are addressed with alternating electric polarity. However, each of the display column drivers has a unipolar output, thereby necessitating a special addressing scheme.

Specifically, when a selected row is addressed with a negative row voltage, the magnitude of that voltage is equal to the threshold voltage so that no light is emitted from any pixel on that row unless there is an additive column voltage also applied to that pixel. When a selected row is addressed with a positive voltage, the magnitude of that voltage is equal to the voltage required for maximum luminance and voltages from the columns are subtracted from that voltage to achieve the desired gray level. These requirements must be reconciled with the use of a voltage ramp starting from zero volts to generate the gray scale reference voltages. The method of reconciliation according to the present invention is to convert the incoming digital 8 bit gray-scale digits to their complement values (i.e. replace binary zeros with ones and binary ones with zeroes) when the row voltage is positive so that the gray-scale level and the corresponding luminance level bear an inverse relation to one another.

This correction by itself, however, is insufficient to achieve gray scale fidelity, and the non-linear ramp function established for a negative row voltage must also be modified for use with a positive row voltage according to Equation 2 given by $V_{g\ pos.}(t)=V_m-V_{g\ neg}(t_m-t)$ where $V_{g\ pos.}(t)$ is the ramp voltage as a function of the running time for the counter for positive row voltage and $V_{g\ neg}(t_m-t)$ is the established ramp voltage function for a negative row voltage expressed as a function of the difference between the time $t_m$ for the ramp to reach the voltage value $V_m$ for maximum luminance and the running time for the counter. Graphically, the two functions $V_{g\ pos.}(t)$ and $V_{g\ neg}(t)$ are rotated 180° with respect to one another. Thus, for the luminance versus voltage curve of FIG. 3, both functions assume a convex shape (positive second derivative with respect to time) for the initial portion of the curve and a concave shape (negative second derivative with respect to time) for the remaining portion of the curve to a maximum value of $t=t_m$. The two functions derived for the luminance curve of FIG. 3 are shown in FIG. 4.

There are various techniques that can be used to generate the appropriate non-linear voltage ramp functions $V_{g\ pos.}(t)$ and $V_{g\ neg}(t)$. According to the preferred embodiment of FIG. 6, two time-dependent voltage feedback controlled current sources (I-1 and I-2 circuits) are used to generate the two segments of the non-linear ramp. The I-1 current source has a current magnitude that decreases with time, and the I-2 current source has a magnitude that increases with time. By controlling the proper timing of switching between the two current sources, as determined by the Threshold Control Circuit, and by directing the currents to an Integrator Circuit, an approximation to the voltage ramp curve of FIG. 4 is generated.

The output of the Integrator Circuit is applied to the conventional Column Driver comprising a counter and Sample-and-Hold (S/H) circuit.

The shape of the generated non-linear ramp voltage can be adjusted or fine-tuned for a particular panel characteristic by altering the functional parameters of the current sources, as discussed in greater detail below with reference to FIG. 7.

In addition, a Frame Polarity Control Circuit is included in the ramp generator to select between the two ramp curves for positive and negative row voltages/frames.

Closer approximations to the curves of FIG. 4 or similar curves for displays having different luminance versus applied voltage characteristics can be generated using three or more current sources with different time-dependent functions selected sequentially in proper timing and sequence, or connected in various parallel combinations.

Figure 5:
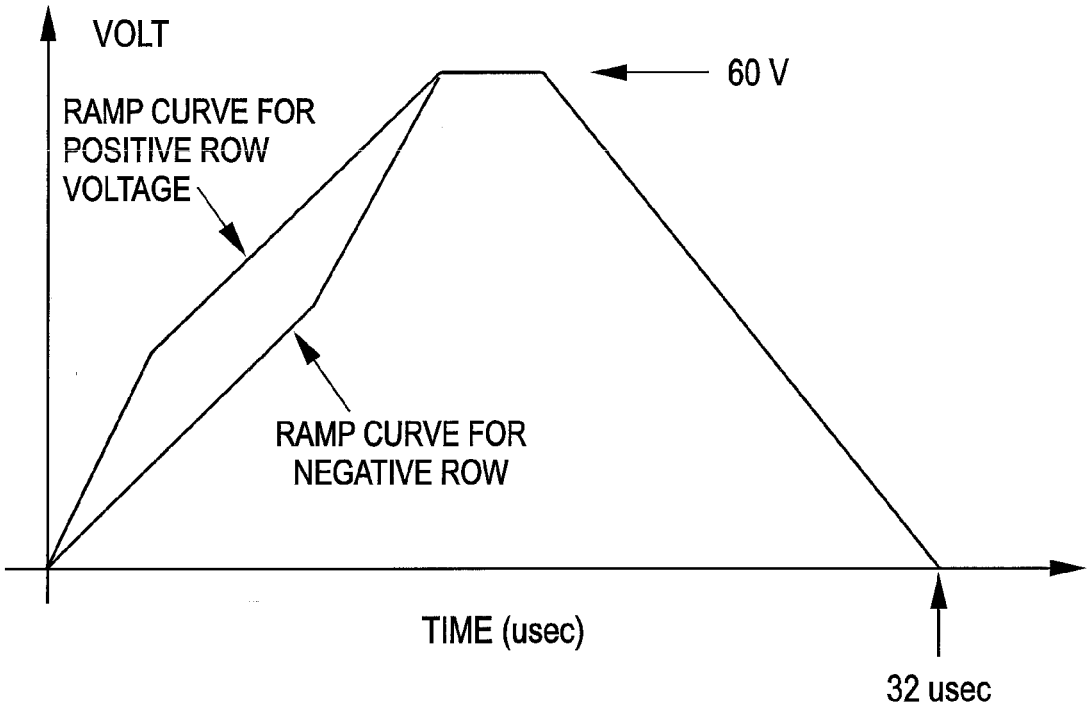
FIG. 5 shows a stepwise linear approximation of the Gamma correction curve of FIG. 4.
Figure 6:
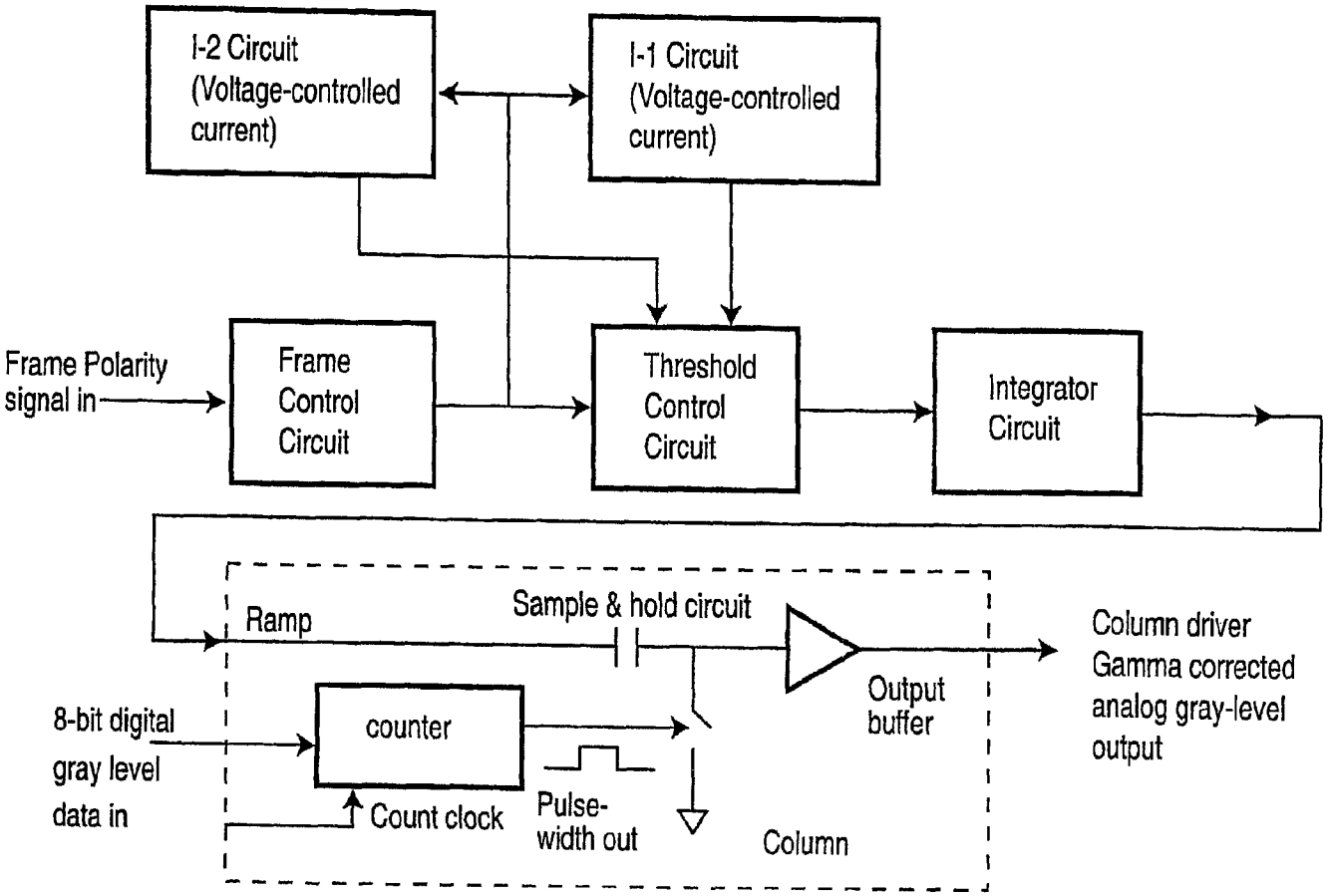
FIG. 6 is a block diagram of a non-linear ramp generator for Gamma correction according to the preferred embodiment.

A simplified alternative to the preferred embodiment of FIG. 6 is to substitute the two time-dependent variable current sources with two constant (time-independent) current sources. This results in a stepwise ramp curve similar to that of FIG. 5. While more simple in design, the stepwise ramp provides gray scale correction with degraded performance as compared to the double-inverted-S ramp of FIG. 4.

Figure 7:
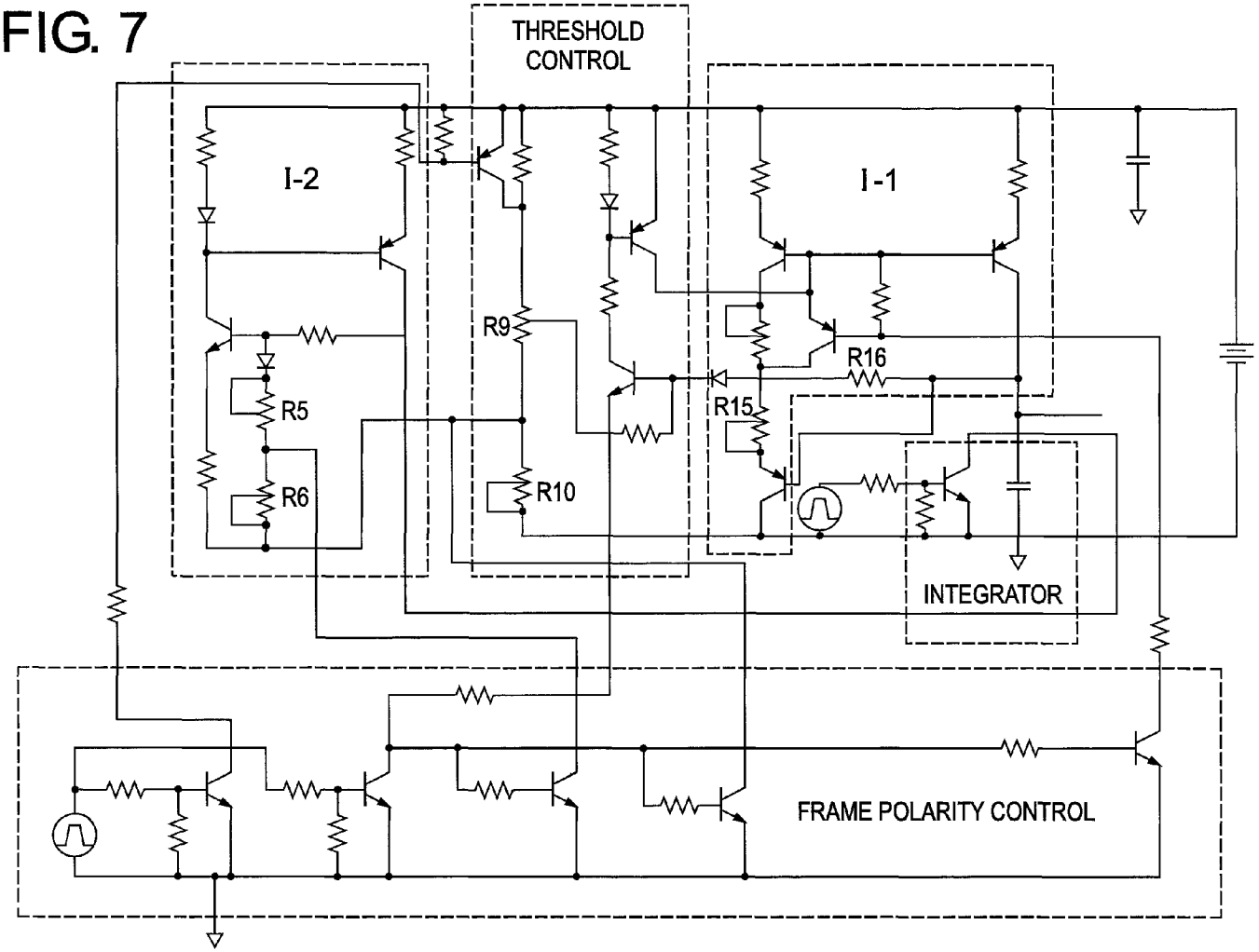
FIG. 7 is a schematic circuit diagram for a successful prototype of the non-linear ramp generator of FIG. 6.

A successful prototype of the voltage ramp generator is shown in FIG. 7. The dashed line blocks represent circuitry that provide the functionality of the blocks in FIG. 6. This circuit also includes control inputs for independent adjustments of three critical parameters for each of the non-linear ramps for both negative and positive row polarities, and also the timing for automatic switching between the two non-linear ramps as controlled by the frame polarity synchronization pulse from the display system. The three critical parameters are the curvature of the first segment of the non-linear ramp (adjusted through R15 and R16 of FIG. 7), the transition voltage level for switching between the two non-linear ramp segments (adjusted through R9 and R10 of FIG. 7), and the curvature of the second segment of the non-linear ramp (adjusted through R5 and R6 of FIG. 7). A ramp reset signal derived from the system control electronics is used to reset and synchronize the non-linear ramp for every scan cycle of the display.

The procedure for the adjustment and optimization of the non-linear ramp for each display panel is first to generate the luminance versus gray-level characteristic of a particular panel using the conventional single linear ramp. An ideal characteristic curve is then derived based on Equation 1 and the luminance of the panel at the maximum gray level. With the assumed value of 2 assigned to $\alpha$ in Equation 1, the appropriate value of 'A' can be generated by trial and error (for example using Microsoft EXCEL software). With the one-to-one mapping between the panel characteristic curve and the ideal characteristic curve, an ideal shape of the non-linear ramp can be generated. The three critical parameters of the non-linear ramp are adjusted based on the generated calculated ideal ramp.

A gray-scale correcting circuit was built for a 17 inch 480 by 640 pixel VGA format diagonal thick film colour electroluminescent display using Hitachi ECN2103 row drivers and Supertex HV623 column drivers. Each pixel had independent red, green and blue sub-pixels addressed through separate columns and a common row. The threshold voltage for each of the red, green and blue sub-pixels of this display was 140 volts. The circuit was used in conjunction with an energy recovery resonant sine-wave drive circuit with a compensating circuit to eliminate gray level variations due to the variable capacitive impedance of the panel as exemplified in above-mentioned and incorporated U.S. Pat. Nos. 6,448,950 and 6,819,308.

Figure 8:
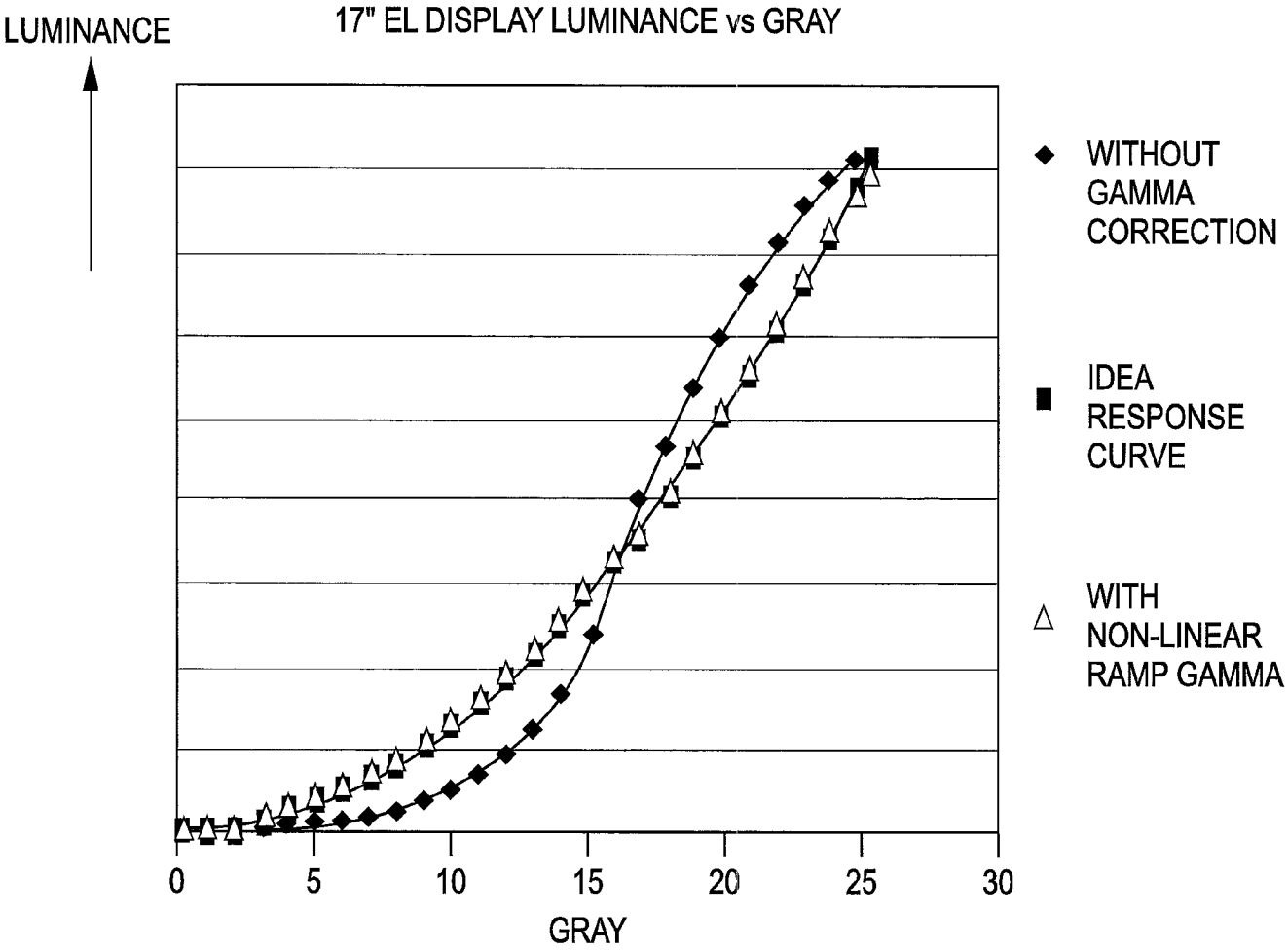
FIG. 8 shows luminance versus gray level curves for a 17 inch thick dielectric electroluminescent display both using the Gamma correction circuit of FIG. 7 and without using the Gamma correction circuit.

FIG. 8 shows the relationship between luminance and gray-level number for the successful prototype 17" display with a conventional single linear ramp compared to one with the non-linear ramps for positive and for negative row voltages of the instant invention. An ideal characteristic curve is also provided for comparison. The characteristic curve generated using the non-linear ramps shows very close proximity to the ideal characteristic.

Although multiple specific embodiments of the invention have been described herein, it will be understood by those skilled in the art that variations may be made thereto without departing from the spirit of the invention or the scope of the appended claims.

The invention claimed is:

1. A gray scale column driver circuit for an alternating current dielectric electroluminescent display comprising rows, columns that intersect the rows and pixels at the intersections of said rows and columns, said column driver circuit comprising:

a counter receiving video signal gray level data and in response counting for a time interval proportional to said gray level data;

a non linear analogue voltage ramp generator connected to said counter, said non linear analogue voltage ramp generator outputting a first ramping voltage during said time interval when a positive voltage is applied to a row of said electroluminescent display and outputting a second ramping voltage when a negative voltage is applied to a row of said electroluminescent display, wherein each said ramping voltage is defined by a function representing a curve having an initial convex portion and signifying a positive second derivative over time followed by a concave portion and signifying a negative second derivative over time; and a column driver receiving the ramping voltage and in response applying driving pulses to the columns of said dielectric electroluminescent display.

2. The gray scale column driver circuit of claim 1, wherein said counter is an 8-bit counter for delineating said time interval to define 256 gray levels.

3. The gray scale column driver circuit of claim 1, wherein said non linear analogue voltage ramp generator further comprises an integrator circuit and at least two current sources generating and applying currents to said integrator circuit such that when a first one of said current sources is connected to said integrator circuit the convex portion of said ramping voltage being output is generated, when said at least two current sources are connected in parallel to said integrator circuit a transition portion of said ramping voltage being output that is between said convex portion and said concave portion is generated, and when a second one of said current sources is connected to said integrator circuit the concave portion of said ramping voltage being output is generated.

4. The gray scale column driver circuit of claim 3, wherein said first one of said current sources generates a current that decreases during said time interval, and said second one of said current sources generates a current that increases during said time interval.

5. The gray scale column driver circuit of claim 3, wherein said at least two current sources are time-dependent voltage feedback controlled current sources.

6. The gray scale column driver circuit of claim 3, wherein said at least two current sources are constant current sources.

7. The gray scale column driver circuit of claim 3, wherein said non linear analogue voltage ramp generator further comprises a threshold control circuit for controlled switching of said at least two current sources.

8. The gray scale column driver circuit of claim 3, wherein said non linear analogue voltage ramp generator further comprises a frame polarity control circuit selecting between said first ramping voltage for said positive row voltage and said second ramping voltage for said negative row voltage.

9. The gray scale column driver circuit of claim 7, wherein said threshold control circuit further includes a control input setting a voltage of the transition portion between the convex and concave portions of said ramping voltage being output.

10. The gray scale column driver circuit of claim 9, wherein said at least two current sources are time-dependent voltage feedback controlled current sources.

11. The gray scale column driver circuit of claim 9, wherein said at least two current sources are constant current sources.

* * * * *